United States Patent [19]

Glantschnig et al.

[11] Patent Number: 4,542,692

[45] Date of Patent: Sep. 24, 1985

[54] RELEASABLY COUPLED UPPER AND LOWER CARRIAGE APPARATUS FOR THE TREATMENT OF WEBS

[75] Inventors: Josef Glantschnig, Wölfnitz; Peter Gugl; Ernst Puntschart, both of Klagenfurt; Johannes P. M. Zimmer, Klagenfurt, all of Austria

[73] Assignee: Johannes Zimmer, Klagenfurt, Austria

[21] Appl. No.: 658,130

[22] Filed: Oct. 5, 1984

[30] Foreign Application Priority Data

Oct. 6, 1983 [AT] Austria ..... 3558/83

[51] Int. Cl.[4] ..... B41F 15/46

[52] U.S. Cl. ..... 101/123; 118/256; 118/258; 118/406

[58] Field of Search ..... 101/114, 118–119, 101/123, 126; 118/256–262, 406

[56] References Cited

U.S. PATENT DOCUMENTS

| | | | |
|---|---|---|---|
| 3,889,629 | 6/1975 | Black | 101/123 X |
| 3,988,986 | 11/1976 | Zimmer | 101/123 |
| 4,090,443 | 5/1978 | Gasser | 101/123 |

FOREIGN PATENT DOCUMENTS

| | | | |
|---|---|---|---|
| 334861 | 2/1977 | Austria | 101/123 |
| 2628585 | 1/1977 | Fed. Rep. of Germany | 101/123 |
| 2722069 | 11/1978 | Fed. Rep. of Germany | 101/123 |
| 2750690 | 5/1979 | Fed. Rep. of Germany | 101/123 |

*Primary Examiner*—E. H. Eickholt

*Attorney, Agent, or Firm*—Karl F. Ross; Herbert Dubno

[57] ABSTRACT

A screen printing installation of the type in which a magnetic member below to be printed attracts an ink applying element against a pattern and a fabric on a support, in which the support is tensioned between a pair of members on an inner frame completely separate from an outer frame in which the upper pattern carrying the carriage is guided. The lower carriage carrying the magnetic member and the upper carriage can be coupled for joint movement through the gaps between the support surface and the longitudinal elements of the outer frame.

9 Claims, 7 Drawing Figures

RELEASABLY COUPLED UPPER AND LOWER CARRIAGE APPARATUS FOR THE TREATMENT OF WEBS

CROSS REFERENCE TO RELATED APPLICATIONS

This application is related to applications Ser. Nos. 613,594 and 614,412 of May 23 and May 25, 1984, respectively.

FIELD OF THE INVENTION

Our present invention relates to an apparatus for the treatment of webs of material and, more particularly, for the printing of textile webs utilizing a printing assembly having cooperating parts on opposite sides of the web.

BACKGROUND OF THE INVENTION

The treatment of webs of material, especially textile webs, e.g. in the printing of patterns thereof, may utilize a bed or surface upon which the web is supported and cooperating members on opposite sides thereof for the treatment operation, e.g. printing a pattern on the textile web.

Screen printing devices utilizing cooperating members on opposite sides of the web are described, for example, in the aforementioned copending applications.

While the present application is particularly directed to the screen printing of textile webs utilizing a round or flat pattern and a magnetically attracted wiper for pressing the printing ink or coloring matter through the pattern onto the fabric, it is equally applicable to other treatments of flat materials, hereinafter generally referred to as webs, utilizing members on opposite sides of the web which are intended to move relative to the web and the surface upon which the web is disposed. Hence the specific description of textile fabric printing will be understood to include description of corresponding treatments of other materials which require similar movements.

In the printing of textile fabrics, it is known to fasten the textile web on a plate, table or other support member which has generally been mounted at its end and along its sides on a support frame carrying the upper and lower cooperating members. The mounting may be effected by temporary bonding, e.g. via a releasable adhesive. The round pattern (see the aforementioned applications) or a flat pattern, as is known from still earlier screen printing systems, is in the form of a screen having local areas through which the ink or dyestuff can be pressed. The round or flat pattern is shiftable on rails in a longitudinal direction of the elongated table and the printing is carried out sectionwise, i.e. first on one area of the web and then on an adjacent area of the web. Consequently, the pattern can have a size corresponding to the pattern repeat and substantially less than the size of the web to be printed.

In recent years, magnetic systems of the type described in the aforementioned copending applications have been developed to utilize magnetic force for applying the blade, roller or other pressing element against the pattern. For this purpose, below the support plate for the textile web or the printing surface, a magnetic beam or magnetic roller must be provided as a countermember toward which the blade or pressing element is attracted.

It is imperative that this magnetic member follow precisely the displacement of the pattern, which can be a screen printing member and, for flat patterns, also be capable of movement in the longitudinal direc tion relative to the pattern in order to imprint an image thereof on the textile web.

This has posed significant problems in prior art systems.

OBJECTS OF THE INVENTION

It is, therefore, a principal object of the present invention to provide an improved apparatus for the treatment of webs of material requiring cooperating members above and below the web, whereby problems which have been encountered heretofore are avoided.

Another object of this invention is to provide an improved apparatus for the screen printing of textile webs which can utilize more effectively the principles set forth in the above-mentioned copending applications.

SUMMARY OF THE INVENTION

These objects and others which will become apparent hereinafter are attained, in accordance with the present invention, whereby we provide two separate frames including an outer frame and an inner frame spaced from the outer frame, the outer frame being provided with a track for a carriage below the web-carrying surface, a second carriage for the upper cooperating members can be provided and a clear space is provided between the outer frame and the web-carrying surface along the entire length thereon through which means can extend for coupling a lower carriage with the upper carriage.

For the screen printing of textile webs, the upper carriage will carry the pattern while the lower carriage will carry the magnetic member drawing the ink-applying blade against the pattern and thus printing an image of the pattern on the web.

According to a feature of the invention, the coupling between the upper and lower carriages is effected by a coupling means comprising a set of indexing notches on one of the carriages and a vertically displaceable pin on the other of the carriages selectively engageable in said notches. The upper carriage can be provided, as noted, with a flat screen printing pattern or a round screen printing pattern and the support surface can be a printing table or sheet which is spanned between members at the end of the inner frame and upon which the textile web can be cemented.

Intermediate these ends, the printing sheet can be supported with swingable supports, spring loaded into a supporting position beneath the printing sheet but deflectable upon movement of the lower carriage along the underside of this printing sheet to clear the carriage. The outer frame can be provided with oscillation-damping means or means preventing shifting thereof, and with any means including, for example, limit switches or the like for reversing and thereby reciprocation of the carriages. A shock absorber for braking the mass of the upper carriage can be provided on one such reversing means.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
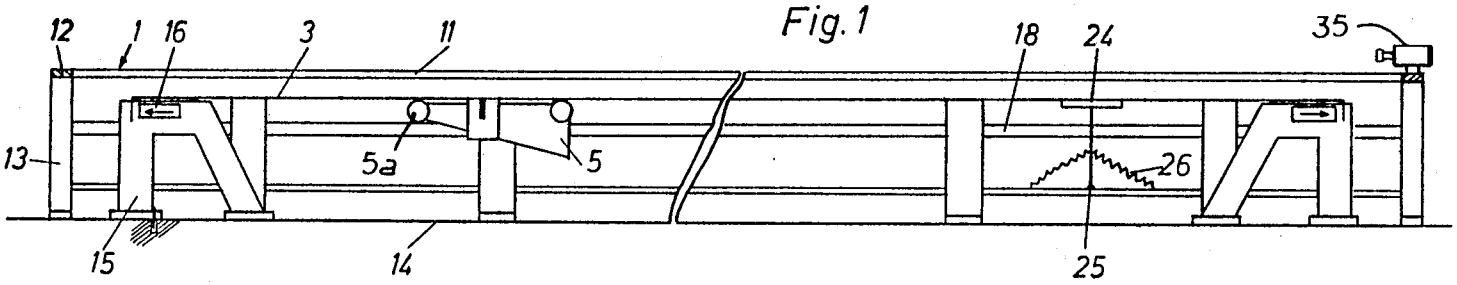
FIG. 1 is a longitudinal section along the line I—I of FIG. 2 through the apparatus of the invention, the upper carriage having been removed.
Figure 2:
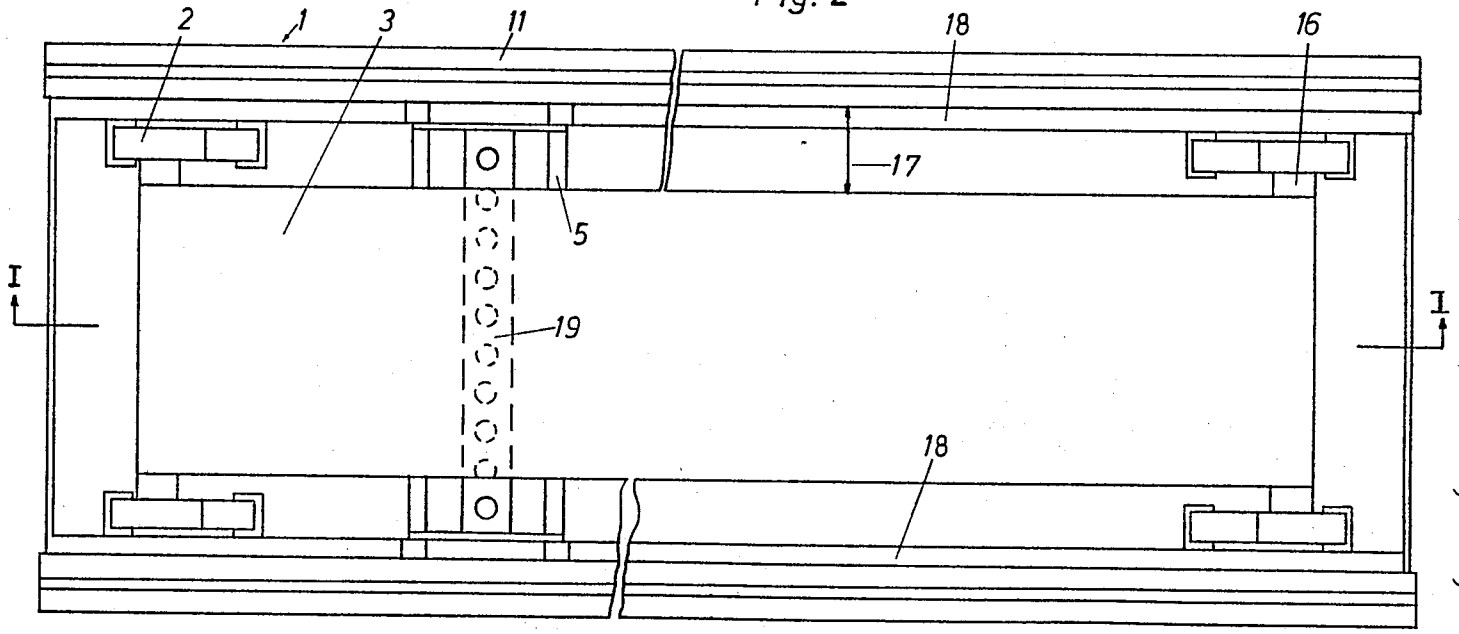
FIG. 2 is a plan view of the apparatus.
Figure 3:
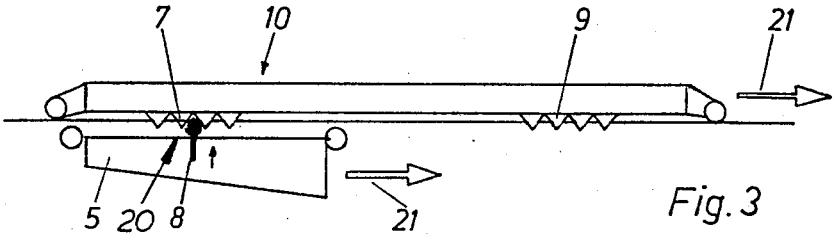
FIGS. 3 through 6 are diagrammatic illustrations of the cooperation of the upper and lower carriages for use with the frame assemblies shown in FIGS. 1 and 2.
Figure 4:
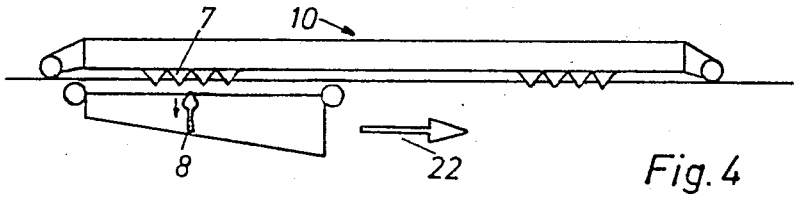
Figure 5:
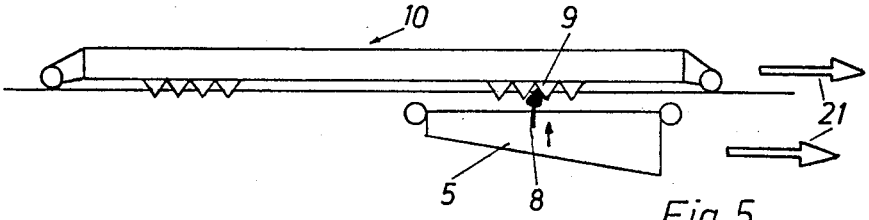
Figure 6:
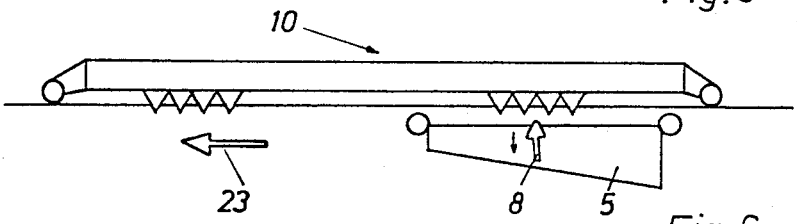

FIGS. 1 and 2 show the basic frame structure of an apparatus which can be utilized to screen print textile fabric in accordance with the principles of the above-identified applications.

In these figures, an outer frame 1 can be distinguished from an inner frame 2. The outer frame 1 comprises longitudinal beams 11 and transverse beams 12. This frame is supported on posts 13 and anchored to the ground 14.

Completely separate from this frame, the frame 2 is provided, the frame 2 having support bucks 15 at the corners and transverse beams 16 interconnecting these bucks. There are no longitudinal beams for the inner frame.

The transverse beams 16 carry the printing surface, sheet or plate 3 which can be tensioned by urging the beams 16 apart in the direction of the arrows in FIG. 1 so that gaps are provided of a width 17 between the longitudinal edges of the printing sheet 3 and the longitudinal beams 11 of the outer frame.

Figure 7:
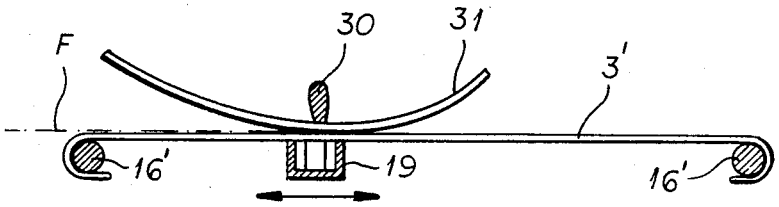
FIG. 7 is a diagram showing the cooperation of the lower magnetic member with a round pattern and a doctor blade utilizing the principles of the aforementioned applications and representing another embodiment of the invention.

As can be seen from FIG. 7, the printing surface 3′ can also be part of an endless member which can be advanced across rollers 16′ corresponding to the beams 16 and tensioning the printing surface 3′.

In either case, the printing surface 3 or 3′ is at no point connected with the support frame 1 but is spaced in all directions from the latter.

The printing sheet 3 or 3′ is supported and tensioned only in the longitudinal direction.

Below this sheet, a carriage 5 is displaceable, the carriage 5 having wheels 5*a* riding on tracks 18 carried by the longitudinal beams 11.

Above the sheet 3 or 3′ and riding on the longitudinal beams 11 is an upper carriage 10 which has only been shown diagrammatically in FIGS. 3 through 6. In these figures, the upper carriage is provided with a flat pattern.

The lower carriage 5 carries a magnetic beam 19 (see the aforementioned copending applications) which can attract a doctor blade or other inner pressing element, (e.g. the element 30 in FIG. 7), against the pattern which in FIG. 7 is shown as a round pattern 31 and against the fabric F which is secured to the printing surface 3 or 3′.

A coupling means generally represented at 20 interconnects the lower carriage with the upper carriage.

While the principles of the printing operation itself will be clear from the aforementioned copending applications, FIGS. 3 through 6 illustrate the operations involving the upper and lower carriages.

Note that the coupling means 20 comprises a set of notches and the teeth (indexing notches 7) formed on the upper carriage and a pin 8 vertically displaceable on the lower carriage to selectively engage these notches.

A corresponding coupling means can be provided at each end of the carriage 5 which extends tansversely of the longitudinal dimension and can pass through the gap 17 between the respective longitudinal edge of the sheet 3 or 3′ over the frame 1.

A second set of indexing notches has been represented at 9 and is longitudinally spaced from the first set 7, as is also apparent from FIGS. 3 through 6.

When the coupling means is engaged (FIG. 3), the two carriages can be moved in registry and synchronism in a common inner direction of arrow 22. Any desired drive can be used for this purpose and even manual displacement may be employed.

After a predetermined stroke, the lower carriage 5 is decoupled from the upper carriage (FIG. 4) so that only the lower carriage can be moved in the direction of the arrow 22.

The lower carriage is then coupled to the upper carriage on the indexing notches 9 and both carriages are again moved in the same direction (arrow 21). After completion of the printing section thereby imprinted, the lower carriage 5 is again decoupled from the upper carriage and returned to its starting position in the direction of arrow 23. It can again be coupled with notches 7 and the process repeated until the entire length of the fiber on the sheet 3 or 3′ has been printed It has already been noted and is illustrated in FIG. 7 that the upper carriage need not exclusively carry a flat pattern but can be provided with a round pattern. The means for rotating these patterns can be a pinion gear or like gearing which can engage with a rack on or adjacent the frame 1.

The textile web is usually adhesively bonded to the printing surface, and an adhesive carriage or a screwing carriage for washing the adhesive residues from the carriage or from the surface can also be coupled to the carriage 5 or the latter can be provided with adhesive applying means or adhesive removing means.

To prevent sagging of the sheet below the printing sheet 3 or 3′, supports 24 are provided (only one shown) and lie in the path of the lower carriage.

The supports 24 are swingable about pivots 25 and are spring-biased into an upright position by the springs 26. When the carriage reaches each support, it will be deflected in one or the other direction and allow the carriage to pass, whereupon the support will spring back to its supporting position automatically.

For printing with flat patterns we may provide the frame carrying the patterns with repeat-generating means, e.g. limit switches or the like to ensure that the flat pattern will return to its original position at the end of a full travel. This means can be mounted on the outer side of the support frame 1 so that it is easily adjustable. In FIG. 1 we have shown a shock absorber 35 mounted on the frame at one such reversing means for braking the mass of the upper carriage.

With the system of the invention, it is possible to provide an electrical drive for the carriages, for the means for controlling the reciprocating movement thereof, etc., so that the entire printing process can be automatic.

When the printing is completed for a given length of time, the upper carriage returns to its original position until it engages an abutment and then the carriage can be advanced again with repetition of the cycle. Any play in the gear wheels driving the round pattern can be taken up so that the starting position of the latter is always the same.

It will be self-understood that the invention is not limited to a printing process and can be utilized for impregnation or other surface treatments.

We claim:

1. An apparatus for the treatment of a web of material which comprises:

a fixed outer frame having longitudinal and transverse elements;

an inner support disposed wholly within said outer frame and fixed with respect to said outer frame, said support comprising a pair of longitudinally spaced transverse support members;

a support surface spanning said members of said support and longitudinally tensioned therebetween, said surface being spaced over its entire length from the longitudinal elements of said outer frame;

an upper carriage mounted on said frame and shiftable longitudinally above said surface and a web which can be mounted on said surface, said upper carriage being provided with means for treating said web;

a lower carriage riding on said frame and disposed below said surface while carrying means cooperating with said means for treating said web; and coupling means for releasably connecting said carriages through the spaces between the longitudinal edge of said sheet and said frame for joint movement along said sheet and said web thereon.

2. The apparatus defined in claim 1 wherein said coupling means includes at least one array of notches on one of said carriages and a vertically displaceable pin on the other of said carriages selectively engageable in one of said notches.

3. The apparatus defined in claim 2 wherein said notches are provided on said upper carriage and said pin is provided on said lower carriage.

4. The apparatus defined in claim 1 wherein said upper carriage is provided with a flat screen printing pattern.

5. The apparatus defined in claim 1 wherein said upper carriage is provided with a round screen printing pattern.

6. The apparatus defined in claim 1, further comprising at least one axial support element disposed below said sheet and deflectable by said lower carriage from a position in which said support element braces said sheet against sagging into a position permitting said lower carriage to pass thereby, and springs biasing said support element into said position in which it braces said sheet against sagging.

7. The apparatus defined in claim 1 wherein said frame is provided with means for automatically reversing the direction of displacement of the respective carriage.

8. The apparatus defined in claim 7, further comprising a shock absorber for braking the mass of the upper carriage, said shock absorber being disposed on said means for automatically reversing said upper carriage.

9. The apparatus defined in claim 2, further comprising a shock absorber on said frame engageable with said upper carriage at the end of the displacement thereof for braking the mass of said upper carriage.

* * * * *